United States Patent [19]

Brugger

[11] Patent Number: 4,600,374

[45] Date of Patent: Jul. 15, 1986

[54] MACHINE FOR MOLDING ARTICLES BY INJECTION MOLDING OR DIE CASTING

[75] Inventor: Werner Brugger, Niederuzwil, Switzerland

[73] Assignee: Gebruder Buhler AG, Uzwil, Switzerland

[21] Appl. No.: 724,614

[22] Filed: Apr. 18, 1985

[30] Foreign Application Priority Data

May 10, 1984 [DE] Fed. Rep. of Germany ..... 3417293

[51] Int. Cl.[4] ..... B29F 1/06

[52] U.S. Cl. ..... 425/149; 425/135; 425/145

[58] Field of Search ..... 425/135, 136, 145, 149, 425/30, 137, 29; 90/13

[56] References Cited

U.S. PATENT DOCUMENTS

| | | | |
|---|---|---|---|
| 2,465,580 | 3/1949 | Ernst et al. . | |
| 3,105,907 | 10/1963 | Colten et al. | 90/13 X |
| 3,632,246 | 1/1972 | Ichikawa et al. . | |
| 3,642,401 | 2/1972 | Wilson | 425/145 X |
| 3,642,404 | 2/1972 | Nagawa . | |
| 3,659,974 | 5/1972 | Neugroschl | 425/29 |
| 3,726,334 | 4/1973 | Sallberg et al. . | |
| 3,741,700 | 6/1973 | Hutchinson et al. . | |
| 3,750,134 | 7/1973 | Weisend . | |
| 3,767,339 | 10/1973 | Hunkar . | |
| 3,797,808 | 3/1974 | Ma et al. . | |
| 3,840,312 | 10/1974 | Paulson et al. | 425/149 |
| 3,859,400 | 1/1975 | Ma . | |
| 3,870,445 | 3/1975 | Hold et al. | 425/145 X |
| 3,904,078 | 9/1975 | Neff et al. . | |
| 3,941,534 | 3/1976 | Hunkar . | |
| 3,982,865 | 9/1976 | Adams et al. | 425/149 |
| 4,060,362 | 11/1977 | Wilson | 425/149 X |
| 4,062,914 | 12/1977 | Hinzpeter | 425/149 X |
| 4,120,629 | 10/1978 | Christian et al. . | |
| 4,161,380 | 7/1979 | Bishop . | |
| 4,184,827 | 1/1980 | Von Herrmann et al. | 425/135 |
| 4,222,725 | 9/1980 | Rodgers, Jr. . | |
| 4,236,181 | 11/1980 | Shibata et al. | 425/137 X |
| 4,240,996 | 12/1980 | Hunkar . | |
| 4,274,823 | 6/1981 | Stanciu et al. | 425/149 X |
| 4,311,446 | 1/1982 | Hold et al. . | |
| 4,325,896 | 4/1982 | Rodgers, Jr. . | |
| 4,335,778 | 6/1982 | Motomura et al. . | |
| 4,344,142 | 8/1982 | Diehr, II et al. . | |
| 4,349,324 | 9/1982 | Neff et al. . | |
| 4,371,483 | 1/1983 | Mattson . | |
| 4,411,609 | 10/1983 | Yoshii et al. . | |
| 4,426,341 | 1/1984 | Tsuzuku et al. . | |
| 4,502,857 | 3/1985 | Hinks . | |
| 4,515,545 | 5/1985 | Hinrichs et al. . | |

FOREIGN PATENT DOCUMENTS

| | | | |
|---|---|---|---|
| 2030108 | 1/1971 | Fed. Rep. of Germany . | |
| 2021739 | 10/1971 | Fed. Rep. of Germany . | |
| 2236421 | 2/1973 | Fed. Rep. of Germany . | |
| 2364559 | 8/1974 | Fed. Rep. of Germany . | |
| 2615445 | 10/1977 | Fed. Rep. of Germany . | |
| 2752847 | 5/1979 | Fed. Rep. of Germany . | |
| 3209834 | 9/1982 | Fed. Rep. of Germany . | |
| 3142811 | 5/1983 | Fed. Rep. of Germany . | |
| 3306214 | 9/1983 | Fed. Rep. of Germany . | |
| 3320435 | 12/1983 | Fed. Rep. of Germany . | |
| 155261 | 5/1982 | German Democratic Rep. | 425/149 |
| 59-185638 | 10/1984 | Japan | 425/149 |
| 837901 | 6/1981 | U.S.S.R. | 425/149 |

OTHER PUBLICATIONS

*Kunststoffberater*, 1978, p. 474.
*Kunststoffe-Plastics*, 1973, pp. 31–33.
*Buehler-Injectrol-GEH*, unknown date.
"Regelungstechnik", B. Jaeger, unknown date.

*Primary Examiner*—J. Howard Flint, Jr.
*Attorney, Agent, or Firm*—Merchant, Gould, Smith, Edell, Welter & Schmidt

[57] ABSTRACT

In a die-casting or injection molding machine transducers are provided for generating a signal corresponding to the injection pressure as well as a signal in accordance with the velocity of the ram device, i.e. the injection screw or the injection piston of the machine. The output signals of these transducers are supplied to a calculating stage for calculating the actual injection power. The resulting signal at the output of the calculating stage is fed to an evaluation device, preferably comprising an indicating device.

19 Claims, 2 Drawing Figures

MACHINE FOR MOLDING ARTICLES BY INJECTION MOLDING OR DIE CASTING

FIELD OF THE INVENTION

This invention relates to a die-casting or injection molding machine comprising a drive for the movement of a ram device within a housing or sleeve of predetermined volume. The drive determines the injection pressure during injection of a molding material, such as light metal or plastic material, into the cavity of a mold, and also the amount of molding material, injected per time unit into the cavity of the mold, is dependent upon the velocity of the movement of the ram device within the housing. Furthermore, there are pressure determining means for said injection pressure and velocity determining means for the velocity of the ram device.

BACKGROUND ART

In die-casting and injection molding machines a ram device is provided for injecting the molding material into the mold. This ram device, in one case, can be formed by an injection piston, or in another case by an injection screw actuated in a piston-like manner. For moving this ram device, drive means are provided, generally formed by an injection drive, and in some cases with an intensifier or booster piston. The above-mentioned housing or sleeve is, in the case of a die-casting machine, formed by an injection or shot cylinder, or—in injection molding machines—by a screw barrel.

Such machines often have a pressure transducer for determining the pressure, and the signals of the transducer are used for control or indicating purposes. The pressure transducer frequently comprises two pressure sensors arranged on the drive cylinder for determining the differential pressure. Moreover, there is a position transducer and a timer by which the velocity of the ram may be determined. A machine with these transducers and a timer is described in the German Pat. No. 3,142,811.

Where a high productivity and quality of the molded products was required, already heretofore the maximum injection power heretofore has been predetermined once and for all in a laboratory test. Perhaps that one informed himself later in a further laboratory test, to know in which range the actual power of the machine could be. The measurement under laboratory conditions did not meet, however, the rough conditions of the workaday in a factory, on the one hand, whereas on the other hand disturbances and interferences of different kind could lead to substantially exceeding the predetermined theoretical "actual" injection power. Therefore, the parameters of the machine had to be preadjusted from the beginning in such a manner that the actual injection power was apropriately below the possible maximum nominal injection power. In this way, it was no longer feasible to attain a high percentage of the nominal injection power.

SUMMARY OF THE INVENTION

It is an object of the invention to increase either the productivity and the quality of the products by a permanent check facility for the characteristic data of the injection power.

This object is attained according to the invention in that the output signals of the transducers are received by a calculating stage for calculating the actual injection power, with the resultant output signals of the calculating stage being fed to an evaluating device. Therein, the evaluating device may also be formed by a control device, but in practice, the actual injection power is dependent to a high extent upon the form of the mold, particularly upon the geometry of the gate, so that it is preferred that the evaluating device may comprise an indicating device.

Although it is, in principle, possible to effect the calculation of the actual injection power on the basis of the pressure of the fluidic pressure medium for the drive and of the velocity of the ram, it is preferred that the calculating stage is formed to calculate the actual injection power under consideration of the pressure of the molding material itself and of the volume flow of the molding material caused by the ram. This volume flow is expressed in units of volume per unit of time. In this way, more significant evaluations are obtained under consideration of the above-mentioned geometry of the gate.

It is particularly suitable, to supply the output signal of the calculating stage to a comparator stage in which a comparison may be effected with a nominal value for the maximum injection power. In this case, the evaluating device receives the output signal of the comparator stage. With such a construction, a comparison of actual and nominal injection power is effected and—in case of an indicator device—the relationship is clearly made manifest to the personnel. The way, how to do it best, substantially consist in that the nominal value may be calculated by means of a nominal value transmitter for a diagramm which shows the projection of the mold resistance line to the line which limits the maximum injection power.

The indication may then be effected in such a manner that the indicator device comprises an alarm device being operative when the actual injection power exceeds and/or falls below a predetermined percentage of the nominal value. Such an alarm device may either be a visual one and/or an acoustic one. Namely, when the machine would operate too near to the maximum possible injection power, there is the danger of bad quality and of waste. A remedy may be, for example, a modification of the gate of the mold, the increase or decrease of the injection pressure or the like. In case, however, the mold has already worked satisfactorily for a time, such an excess may be caused by jammings, e.g. of the ram. For such cases, the evaluating device may, for example, comprise an interruptor switch for interrupting the operation of the whole machine or of only a portion of it (e.g. only for the drive of the ram). But it may also be of interest to know, when the actual injection power falls below a predetermined lower threshold value, in order to enable the personnel to improve the productivity.

BRIEF DESCRIPTION OF THE DRAWING

Further details of the invention will become apparent from the following description of an embodiment schematically illustrated in the drawing, in which:

FIG. 1 shows a die-casting machine together with a block diagramm for calculating and indicating the actual injection power on an image screen, whereas FIG. 2 illustrates the diagramm shown on the image screen of FIG. 1 on enlarged scale and somewhat completed.

DETAILED DESCRIPTION OF THE DRAWING

Figures 1, 2:
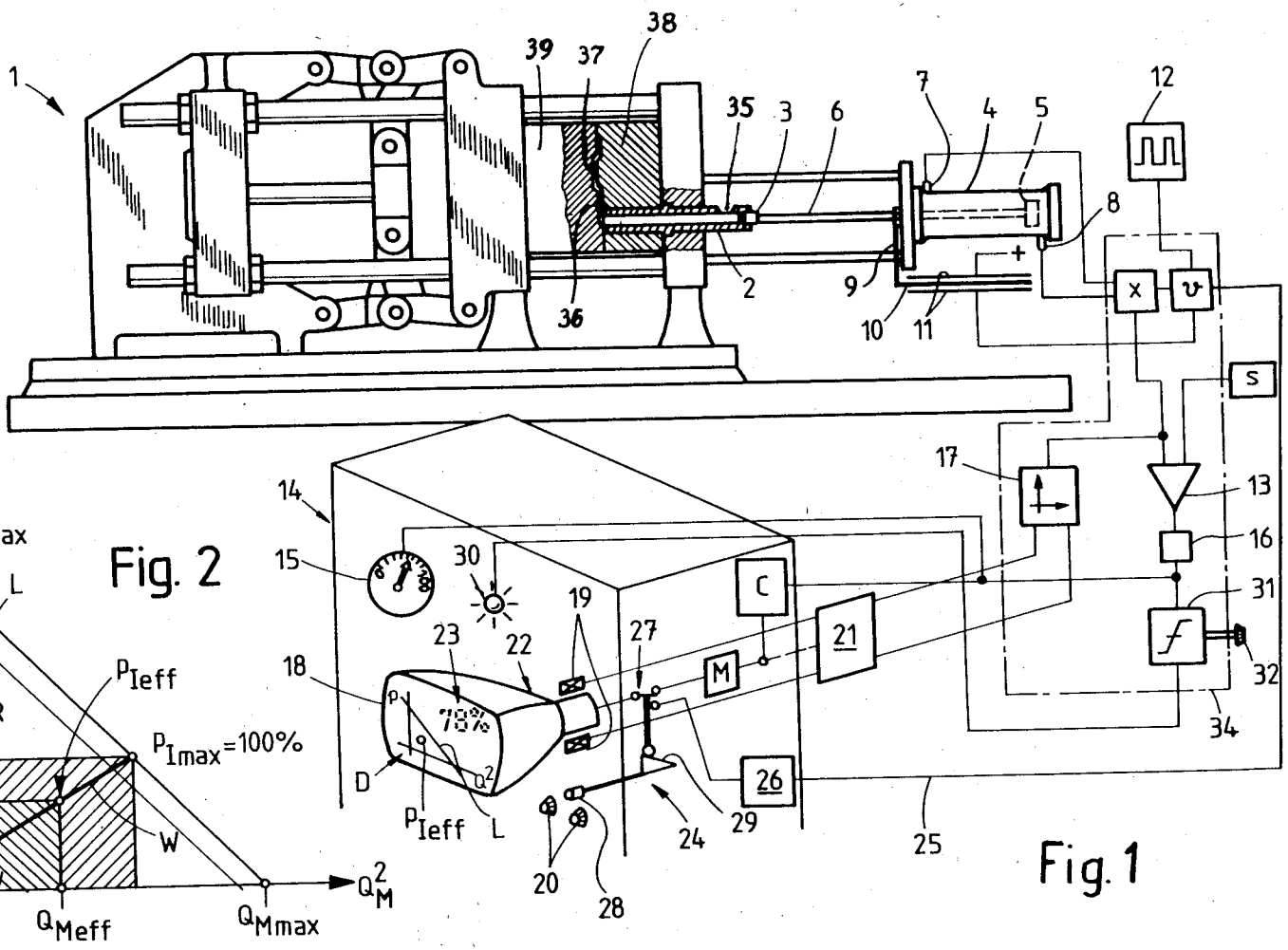

A die-casting machine 1 comprises an injection cylinder 2 in which a piston-like injection ram 3 is slidable in usual manner. For controlling the movement of the injection ram 3, a drive cylinder 4 is provided in which an injection drive piston 5 is slidable by supplying a fluid, particularly hydraulic fluid, in a manner known per se. The drive piston 5 is connected to the injection ram 3 through a relatively large piston rod 6. Thus, molten material, filled into the injection cylinder 2 through an opening 35, may be shot by the piston or ram 3 through a gate 36 into a cavity 37 formed between a stationary mold 38 and a movable mold 39, as is also known per se.

Before and behind the drive piston 5, a respective pressure sensor 7 and 8 is provided as a pressure transducing means for the differential pressure between both sides of the drive piston 5 within the drive cylinder 4. It is to be understood that in this way the injection pressure of the liquid molding material, filled into the injection cylinder before the injection ram, may be determined, and that also other arrangements with a single pressure sensor or a plurality thereof may be used to determine this injection pressure. For instance, the injection force may be measured by a single sensor, e.g. in the form of a wire strain gauge that may be also arranged, in case, on the piston rod 6.

Furthermore, an arm 9 is provided on the piston rod 6 and projects substantially normally to the longitudinal axis of the latter. This arm 9 supports one part 10 of a, e.g. capacitive, transducer for determining the stroke of the piston rod 6, said part 10 being connected to the piston rod 6 to move in parallel direction to it. Of course, also other types of stroke measuring devices may be used. For instance, the slidable part 10 may comprise a relative precise graduation, and an optical readout assembly facing said graduation may be arranged to form an incremental transducer. Moreover, the slidable part 10 may be provided with metal teeth, the movement of which being used to determine the stroke by inductive means. Finally, also the piston rod 6 could comprise itself such markings or could be connected to a further rod protruding from the cylinder 4 on the right side with respect to FIG. 1.

The output signal of the stroke transducer 10, 11 is supplied to a first calculating stage v which also receives the output signal of a timer constituted by a clock generator 12. The calculating stage v calculates the velocity of the injection ram 3 and supplies a corresponding signal to a second calculating stage X. This calculating stage X uses this output signal and the output signals of the directly connected sensors 7, 8 to calculate the actual injection power. The use of calculating stages for carrying out dividing or multiplying operations is well known in this field, e.g. from U.S. Pat. Nos. 3,741,700, 3,797,808 or 3,859,400. For calculating the actual injection power, some formulas have already become known whereby it is calculated substantially according to the following one:

$$P_{eff} = V_G \cdot p \cdot k$$

in which, $P_{eff}$ is the actual injection power;

$V_G$ is the velocity of the injection ram 3 calculated from the output signals of the stroke transducer 10, 11 and of the clock generator 12 during the dynamic mold filling phase;

p is the differential signal obtained from the output signals of the pressure sensors 7, 8 and representing the injection pressure; and k is a constant depending upon the dimensions of the piston drive and of the injection cylinder, which need not be used in this formula, although it is preferred in order to meet better the actual conditions.

Thus, practically speaking, the calculating stage X constitutes substantially a mere multiplicating stage (if one neglects that the above factors themselves may be calculated by other calculating operations). The output signal of this calculating stage X is preferably supplied to a comparator stage 13 comparing the actual injection power with a nominal value. This nominal value corresponds ordinarily to the maximum injection power, as will be described in detail later with reference to FIG. 2, and is determined by means of the parameters contained in a nominal value transmitter S. The comparator stage 13 calculates the percentage of the actual injection power relative to the nominal or maximum injection power. Therefore, also in this stage, substantially only a multiplication is effected with a factor depending upon the machine and the diameter of the injection ram 3 actually used. The ouput signal according to this multiplication corresponds to the percentage of the actual injection power.

Thus, an indicator device in the form of an apparatus compartment 14 may be assigned to the die-casting machine 1, and the output signal of the comparator stage 13 may be fed to a simple pointer instrument 15, e.g. a galvanometer. Suitably, the circuit is designed in such a manner that the output signal of the comparator stage 13 remains for a predetermined time at the output of this stage 13 so that the position of the pointer of the instrument 15 remains stable during this predetermined time. To this end, a storage or memory 16 may be connected to the output of the comparator stage 15.

Besides this indication, expressed as a percentage, just described, it is also possible to use the output signal from the calculating stage X immediately for an indication, without comparing it with the maximum value from the nominal value transmitter S. To this end, the output signal of the calculating stage X may be fed to a coordinate transformer 17 that determines the coordinates for a horizontal and vertical scan of an tube screen apparatus 18 as a function of the value of the output signal of the calculating stage X. For instance, the signal from the coordinate transformer 17 may simply be supplied to the scanning system 19 of the tube screen 18 in order to locate a light spot $P_{Ieff}$ onto the tube screen 18 in a position corresponding to the output signal of the calculating stage X. Of course, instead of a tube, any other type of image screen may be used.

In the simplest case, the tube screen 18 may have adhered thereto a diagramm D so that the relative position of the light spot $P_{Ieff}$ with respect to the diagramm D is shown in accordance with the position of the spot on the tube screen. Such a diagramm D is illustrated in enlarged scale in FIG. 2 and is somewhat completed with respect to the explanation given below.

However, it is equally possible to superimpose the diagramm D on the tube screen 18. To this end, a storage unit M (e.g. a ROM or a RAM) may be provided which contains the diagramm D stored in it. In order to enable the use of the apparatus compartment 14 with different die-casting and/or injection molding machines having different operational characteristics, and therefore also a different form of the diagramm D, the angle and the course of a line L, defining the maximum injection power, may be adjusted by means of two setting knobs 20 (or, in case, also by means of a numerical keyboard).

A converter or storing stage 21 may be connected to the output of the coordinate transformer 17 for displaying the light spot $P_{Ieff}$ in the correct relationship to the diagramm D, supplied by the unit M, as well as for a longer period. Thereby, the output of this stage 21 may be connected not only with the scanning system 19, but also with the image tube 22 itself, e.g. through the unit M, thus operating the tube 22 in the manner of a television tube. Of course, it is equally possible to provide two tubes for a common screen, the one tube supplying the diagramm D, the other one the light spot $P_{Ieff}$. It should, however, be noted that also other superimposing techniques known per se may be applied.

Although the relationship of the actual injection power relative to the nominal injection power or maximum injection power may be read or estimated from the position of the light spot $P_{Ieff}$ relative to the diagramm D, it may be desirable to be able to read also the exact value of percentage from the screen. For this purpose, the signal from the comparator stage 13 is necessary and may be fed, for example, to a character generator C of known construction, the ouput of which being either directly connected to the image tube 22 or through the unit M. By means of the character generator C, an indication of the percentage in correspondance with the output signal of the comparator stage 13 is provided on a predetermined location of the image screen, particularly in the upper right corner of the same, as is illustrated by the numerical display 23.

Since, on the one hand, the information about the actual injection power is of particular interest at the beginning of the production of a molded or die-casted part whereas later possibly other graphic displays may be of more importance, and on the other hand, a separate indicating apparatus, especially a separate image screen, for each graphic display may be too expensive, preferably a selector switch device 24 is provided, by means of which at least the image screen (if desired, also the pointer instrument 15) may be connected to at least a second line 25 supplying another output signal to be indicated. The line 25 is an output line from the calculating stage v and, therefore, supplies the signal corresponding to the velocity of the injection ram 3. As is well known, the velocity of the injection ram 3 over its stroke is an important operational characteristic which may be prepared in a transforming and storing stage 26 in such a manner that a diagramm of the velocity variations during each shot may be supplied to the image screen. Suitably, also the stage 21 is designed as a storing converter or storing stage so that after each shot either the one and the other graph may be displayed on the image screen by actuating the switch 27.

To this end an actuating knob 28 is provided that may be suitably locked in the depressed position (against the force of a spring not shown), which is illustrated in FIG. 1, by any locking means not shown but known per se. By releasing the locking means, the actuating knob 28 returns to its normal position in which the tube may be connected to the line 25. For example, the acuating knob 28 may be connected with an oblique cam surface 29 by which the switch 27 is actuable.

FIG. 1 shows, however, also another indication facility. That is, in the case where the light spot $P_{Ieff}$ comes too close to the line L defining the maximum injection power, there exists the danger of a decrease of quality. Therefore, it is of interest to call the attention of the operating personnel especially to this fact. To this end, an alarm indicator 30 is provided, designed either as an optical and/or acoustic signal transmitter. When the light spot $P_{Ieff}$ comes too near to the line L, thereby passing a nominal value corresponding to a predetermined percentage of the maximum injection power (line L)—and in the diagramm to a line 33 that is parallel to the line L—this may release a signal at the ouput of a threshold value stage 31, said signal actuating the alarm indicator 30. Since, as already mentioned, with this threshold value it is the question of a nominal value line being parallel to the line L of the diagramm at the side facing the zero point, the nominal value stage 31 is not, of course, a mere threshold value switch of the type of a Schmitt-trigger, but constitutes a kind of computing stage operating with the formula given above.

In order to adapt this threshold value stage 31 to the respective operational requirements, an adjusting device 32 may be provided. By means of this adjusting device 32 the distance between the line L defining the maximum injection power L (vide FIG. 2) and the line 33 defining the threshold value of the threshold value stage 31 may be adjusted.

It is equally possible, to connect another threshold value stage with the ouput of the comparator stage 13, thus defining a lower threshold value. Such a threshold value stage may then be connected with the alarm indicator 30 or another alarm indicator for giving a signal when the actual injection power does not come up to a predetermined minimum injection power, thus indicating to the personnel that the machine 1 is not optimally utilized. Of course, in the same manner as known threshold value switches can provide a lower threshold level and an upper threshold level too, also a single threshold value stage 32 may define the upper threshold line 33 as well as a parallel lower threshold line being shifted to the zero point of the diagramm D with respect to the line 33. Thus, reducing the invention to practice, either an additional alarm indicator may be provided or some of the indicating instruments 15, or 30 may be omitted, if desired.

On an image screen, as the screen 18, the diagramm may only be represented in the manner shown in FIG. 1, i.e. simply the diagramm may be shown together with the light spot $P_{Ieff}$. However, also additional lines, which facilitate the understanding, may be represented as shown in FIG. 2 and described below.

For a certain injection molding or die-casting machine, there is a predetermined position and inclination of the line L indicating the maximum injection power, since the maximum pressure $p_{CMmax}$ is just given as well as the maximum volume flow, to be mastered by the injection ram 3 (FIG. 1), as a function of the velocity of the injection ram 3. Therefore, it may be desirable for different machines to adapt the line L in order to enable the use of a single apparatus compartment 14 for different machines. This is the reason, why the adjustment knobs 20 (FIG. 1) or an analogous adjustment device may be provided, by means of which practically the points $p_{CMmax}$ und $Q_{Mm}$ can be shifted along the respective axis of the diagramm. In this way, the position and inclination of the line L may be changed. The simplest manner to do this, is not to displace directly these points by the knobs 20, but in reality (if a diagramm similar to the diagramm D is imagined, but representing the pressure $p_{Istat}$ of the pressure medium for driving the injection ram 3 in relation to the velocity v of the same) the knobs 20 change the values of the pressure $p_{Istat}$ and of the velocity v, which values may easier be determined, after which adjustment the corresponding points $p_{CMmax}$ and $Q_{Mmax}$ will be determined in a calculating stage connected to the knobs 20 in a manner not shown. This calculating stage may be formed, for example, by the calculating stage X.

Even an automatic adjustment—i.e. without the knobs 20—may be realized by providing a pressure sensor for the pressure of the pressure medium, e.g. for the pressure of an inert gas contained in an accumulator usually arranged on die-casting machines (vide, for example, the U.S. Pat. No. 2,465,580), the output of said pressure sensor being directly connected to the above-mentioned calculating stage so that a change of the pressure of the medium, particularly in the accumulator, would lead automatically to an adaption of the diagramm D. In this connection, it is to be understood that additionally or alternatively to the diagramm D, the above-mentioned diagramm showing the point $p_{Istat}$ and v instead of $p_{CMmax}$ and $Q_{Mmax}$ may be displayed, but its significance is less for non-consideration of the actual conditions, especially of the gate geometry of the mold.

Moreover, it would be conceivable that different injection cylinders 2 or injection rams 3 can be provided with different code markings (e.g. recesses of different size, contact bridges in different positions or of different length, or also optically readable markings), by means of which and of suitable code reading means the respective data may be automatically transmitted to the respective calculating stage, particularly the stage X, when injection cylinder 2 and injection ram 3 are exchanged. Such code markings are used in various technical fields, e.g. in photography for marking film cartridges, and therefore are known per se. It is to be understood that such code markings may be applied independently from the indication of the injection power, for instance in control circuits for controlling the shot.

Now, when the point $P_{Ieff}$ is inserted into a diagramm D that shows only the line L, as in FIG. 1, the projection of a line W drawn from the zero point to the operation point $P_{Ieff}$ onto the line L—which line W represents the so called resistance line of the mold—results in the maximum power point $P_{Imax}$ which corresponds to an injection power of 100%. Exactly speaking, it is a rectangle R, the sides of which being drawn from the point $P_{Imax}$, found by the projection of the mold resistance line W onto the line L, to each axis of the diagramm, and the area of this rectangle corresponds to the maximum injection power. Analogously, a rectangle r, drawn from the operational point $P_{Ieff}$ to each axis of the diagramm, corresponds to the actual injection power. Therefore, the indication, shown on the pointer instrument 15 or in the area of the numerical display 23 of FIG. 1, corresponds to the relationship of the surface areas of both rectangles R and r, expressed in per cents. Thus, also the mold resistance line W and, in case, the rectangle r and/or the rectangle R, or the actual operational pressure $p_{CMeff}$ and/or the actual volume flow $Q_{Meff}$ may be displayed on the image screen of FIG. 1, if desired.

Numerous modifications are possible within the scope of the invention; for example, some of the stages described with reference to FIG. 1, or the better part of them, may be lodged within or may be constituted by a process calculator 34 (indicated in dash-dotted lines), e.g. a microprocessor. This is the more advantageous, as calculator operations will have to be effected particularly in stages X, 13, 17 and, in case also, in stage 31. Independent upon the manner how the indicator device in compartment 14 will be realized in practice, it will provide a facility to prevent in time a worsening of quality, but to operate the machine nevertheless with high productivity.

As already mentioned, the circuitry shown in FIG. 1 may also be brought into play for controlling purposes, for instance, by controlling an interruptor switch by the output signal of the threshold stage 31. This interruptor switch may be situated in the main circuit (not shown) of the die-casting machine 1 for interrupting the same when the actual injection power exceeds the (upper) threshold value of the threshold stage 31, i.e. a predetermined percentage of the maximum injection power or the maximum injection power itself. In this way, bad quality will be reliably prevented, without being left to the alertness of the operating personnel. Of course, it would also be conceivable to interrupt only the drive for the injection ram 3.

A further possibility of the evaluation consists in comparing the output signal of the calculating stage X with a signal that corresponds to the locking force of the die or mold 38, 39 of the machine 1 in order to perceive a so-called "die-venting" in time. In principle, the comparator stage necessary for this purpose may be connected to a circuit similar to that comprising the alarm indication 30 and including a threshold stage and/or an interruptor arrangement for the machine 1 to interrupt the same in case of the danger of die-venting, i.e. of a slight spreading of both parts of the mold or die 38 and 39.

Furthermore, it is conceivable to realize an automatic control of the accumulator pressure as a function of the output signal of the calculating stage X. As already mentioned above, the code marking on injection cylinder and/or injection ram may also be advantageous as an input of the respective data independently upon the evaluation of the actual injection power. Of course, an indication may also be provided by liquid crystal displays, light emitting diodes or the like, particularly for a numerical display.

What I claim is:

1. Apparatus for molding articles from a molding material, comprising:

mold means defining a cavity and having an predetermined characteristic to be expressed in a diagram as a mold resistance line;

injection sleeve means of hollow cross-section and a predetermined maximum volume connected in fluid communication with the mold cavity, said sleeve means having a supply opening for the supply of molding material to the hollow interior of said injection sleeve means for discharge under pressure into said cavity;

injection ram means including a piston movable axially within said hollow injection sleeve means;

drive means for moving said injection ram means within said injection sleeve means, said drive means determining the shot pressure of said molding material, the volumetric flowrate of which depends upon velocity of said injection ram means within said injection sleeve means;

means for sensing the pressure of the molding material when shot into the mold cavity and the shot pressure of said drive means, and generating a first output signal representative of the differential pressure across the piston of said injection ram means;

means for sensing the velocity of said injection ram means and for generating a second output signal representative thereof;

calculating means for receiving said first and second output signals, calculating the actual injection power of the machine as a function of the differential pressure and the volumetric flowrate of molding material into the mold cavity, and generating a third output signal representative of the actual injection power; and means for displaying the third output signal for evaluation by operating personnel.

2. The apparatus of claim 1, wherein said velocity sensing means comprises:

a transducer for sensing the stroke of said injection ram means, and a timer.

3. The apparatus of claim 1, further including:

comparator means for receiving said third output signal, comparing it with a nominal value representative of the maximum injection power, and generating fourth output signal representative of percentage of actual injection power.

4. The apparatus according to claim 3, further including:

memory means interposed between said comparator means and said display means for storing the fourth output signal.

5. The apparatus according to claim 3, further including:

means for transmitting the nominal value to said comparator means; said comparator means including computing means for computing this nominal value as a percentage of the mold resistance line in relation to a line defining the maximum injection power.

6. The apparatus of claim 1, wherein said display includes at least one indicating means.

7. The apparatus according to claim 6, further including:

comparator means for receiving said third output signal, comparing it with a nominal value representative of the maximum injection power, and generating a fourth output signal representative of percentage of actual injection power;

said display means also receiving said fourth output signal.

8. The apparatus according to claim 7, wherein said indicating means includes an alarm responsive to predetermined deviation of the actual injection power represented by said third signal from the nominal value represented by said fourth signal.

9. The apparatus according to claim 7, wherein said indicating means includes a screen for receiving and displaying said fourth output signal.

10. The apparatus according to claim 9, further including:

character generating means for converting said fourth output signal into respective characters to be projected onto said image screen means.

11. The apparatus according to claim 9, further including:

selector switch means coupled to said velocity sensing means and said computer means for selectively providing an indication of said second and fourth output signals on said image screen means.

12. The apparatus according to claim 9, further including:

means for projecting a diagram of the maximum injection power onto said image screen means.

13. The apparatus according to claim 12, wherein said means for projecting a diagram includes storage means containing said diagram to provide a respective diagram signal.

14. The apparatus according to claim 12, further including:

transforming means for converting said fourth output signal into a marking within said diagram.

15. The apparatus of claim 1, wherein at least said calculating means are contained in process calculating means.

16. The apparatus according to claim 15, wherein said process calculating means comprises also said comparator means.

17. The apparatus according to claim 15, wherein said process calculating means comprises a micro-processor.

18. Apparatus for molding articles from a molding material, comprising:

mold means defining a cavity and having a predetermined characteristic to be expressed in a diagram as a mole resistance line;

injection sleeve means of hollow cross-section and a predetermined maximum volume connected in fluid communication with the mold cavity, said sleeve means having a supply opening for the supply of molding material to the hollow interior of said injection sleeve means for discharge under pressure into said cavity;

injection ram means including a piston movable axially within said hollow injection sleeve means;

drive means for moving said injection ram means within said injection sleeve means, said drive means determining the shot pressure of said molding material, the volumetric flowrate of which depends upon the velocity of said injection ram means within said injection sleeve means;

means for sensing the pressure of the molding material when shot into the mold cavity and the shot pressure of said drive means, and generating a first output signal representative of the differential pressure across the piston of said injection ram means;

means for sensing the velocity of said injection ram means and for generating a second output signal representative thereof;

calculating means for receiving said first and second output signals, calculating the actual injection power of the machine as a function of the differential pressure and the volumetric flowrate of molding material into the mold cavity, and generating a third output signal representative of the actual injection power; and comparator means for receiving said third output signal, comparing it with a nominal value representative of the maximum injection power, and generating a fourth output signal representative of percentage of actual injection power;

means for receiving and displaying the third and fourth output signals for evaluation by operating personnel.

19. Apparatus for molding articles from a molding material, comprising:

mole means defining a cavity and having a predetermined characteristic to be expressed in a diagram as a mold resistance line;

injection sleeve means of hollow cross-section and a predetermined maximum volume connected in fluid communication with the mold cavity, said sleeve means having a supply opening for the supply of molding material to the hollow interior of said injection sleeve means for discharge under pressure into said cavity;

injection ram means including a piston movable axially within said hollow injection sleeve means;

drive means for moving said injection ram means within said injection sleeve means, said drive means determining the shot pressure of said molding material, the volumetric flowrate of which depends upon the velocity of said injection ram means within said injection sleeve means;

means for sensing the pressure of the molding material when shot into the mold cavity and the shot pressure of said drive means, and generating a first output signal representative of the differential pressure across the piston of said injection ram means;

means for sensing the velocity of said injection ram means and for generating a second output signal representative thereof;

calculating means for receiving said first and second output signals, calculating the actual injection power of the machine as a function of the differential pressure and the volumetric flowrate of molding material into the mold cavity, and generating a third output signal representative of the actual injection power;

comparator means for receiving said third output signal, comparing it with a nominal value representative of the maximum injection power, and generating a fourth output signal representative of percentage of actual injection power;

means for receiving and displaying the third and fourth output signals for evaluation by operating personnel; and alarm means responsive to said comparator means for indicating if the fourth output signal passes a threshold corresponding to a predetermined percentage of the maximum injection power.

* * * * *